United States Patent [19]

Broeckx et al.

[11] 4,002,437

[45] Jan. 11, 1977

[54] DIESEL FUEL COMPOSITION

[75] Inventors: Willy P. Broeckx, Reet; Lothar G. Dulog, St. Martens-Latem, both of Belgium

[73] Assignee: S.A. Texaco Belgium N.V., Brussels, Belgium

[22] Filed: Feb. 27, 1975

[21] Appl. No.: 553,712

[52] U.S. Cl. ..... 44/66; 44/DIG. 4; 252/392

[51] Int. Cl.[2] ..... C10L 1/18

[58] Field of Search ..... 44/66, DIG. 4; 252/392

[56] References Cited

UNITED STATES PATENTS

| | | | |
|---|---|---|---|
| 2,632,695 | 3/1953 | Landis et al. | 44/66 |
| 2,841,126 | 7/1958 | Cantrell et al. | 44/DIG. 4 |
| 3,228,758 | 1/1966 | Bauer | 44/72 |
| 3,879,308 | 4/1975 | Miller | 44/66 |

*Primary Examiner*—Allen B. Curtis
*Assistant Examiner*—Y. Harris-Smith
*Attorney, Agent, or Firm*—T. H. Whaley; C. G. Ries; James J. O'Loughlin

[57] ABSTRACT

Diesel fuel composition comprising a mixture of hydrocarbons boiling in a range from about 310° to 475° F. containing an additive mixture composed of (1) dimeric and trimeric acids produced by the condensation of unsaturated aliphatic monocarboxylic acids having between about 16 and about 18 carbon atoms per molecule, and hydroxyaliphatic monocarboxylic acids having between about 16 and about 18 carbon atoms per molecule, (2) a normally liquid completely or partially neutral amine salt of an oxo-alkyl acid ester of orthophosphoric acid in which each esterifying oxo-alkyl group contains 13 to 16 carbon atoms and the amine is an aliphatic hydrocarbon monoamine of 16 to 24 carbon atoms in which each aliphatic hydrocarbon radical is attached to the nitrogen through a saturated carbon atom, (3) an aliphatic demulsifier consisting of fatty acids alkoxylated by a mixture of ethylene and propylene oxides and (4) a saturated hydrocarbon solvent.

1 Claim, No Drawings

DIESEL FUEL COMPOSITION

BACKGROUND OF THE INVENTION

1. Field of the Invention

Until quite recently, the diesel fuel oil compositions burned in or employed to power diesel locomotives and diesel motor vehicle were the heavier diesel fractions generally boiling from about 300° to about 650° F. These diesel fuel oil compositions were very satisfactory from an engine wear standpoint and also were efficient functionally as well as being economical. The one serious drawback that these fuel oil compositions possess, however, is that they are not clean burning fuels and in use give rise to significant amounts of smoke pollution. Because of new environmental standards, the use of such fuel oil compositions has been seriously limited or completely restricted generally by statutory measures.

A significant shift to lighter and cleaner burning diesel fuel oils was made in order to overcome the noted emissions or pollution problem of the heavier diesel fuels and thus meet the new statutory standards. The lighter diesel fuel oil compositions are very satisfactory from the pollution standpoint i.e., they meet or surpass the regulatory limits on smoke and exhaust emissions. Unfortunately, the lighter diesel fuel oils are notably deficient in lubricity or lubricating properties with the result that engine wear from the use of the light diesel oil fuels in internal combustion reciprocating diesel engines became a very serious problem. Lubricity agents were added to the light diesel fuel oils to overcome the wear problem but with mixed results. In some cases involving the so-called light diesel fuel oils, lacquer formation in the fuel injectors have been found to seriously interfere with the proper operation of the diesel engines.

2. Description of the Prior Art

U.S. Pat. No. 2,632,695 discloses rust inhibited light petroleum products including gasoline, naphthas and burning oils in which the rust inhibitor employed comprises dimeric or tri-meric acids produced by the condensation of two or three monomers of an unsaturated aliphatic monocarboxylic acid or hydroxy aliphatic monocarboxylic acid having between about 16 and 18 carbon atoms per molecule.

U.S. Pat. No. 3,228,758 discloses distillate hydrocarbon fuels, such as gasoline, kerosene, fuel oils, diesel fuels and furnace oils, inhibited with respect to color and haze formation, rust inhibited, and inhibited in the formation of ice in the carburetor passage of automobile engines due to the incorporation therein of a normally liquid completely or partially neutral amine salt of branched chain primary alkyl acid esters or orthophosphoric acid in which each esterifying alkyl group contains 13 to 16 carbon atoms and the amine is an aliphatic hydrocarbon monoamine of 6 to 24 carbon atoms in which each aliphatic hydrocarbon radical is attached to the nitrogen through a saturated carbon atom.

SUMMARY OF THE INVENTION

A novel diesel fuel composition is provided comprising a base fuel consisting of a mixture of hydrocarbons boiling in the range from about 310° to 475° F. containing an additive mixture composed of 100 to 200 parts by weight of a polymer selected from the group consisting of (1) dimeric acids produced by the condensation of unsaturated aliphatic monocarboxylic acids having between about 16 and about 18 carbon atoms per molecule, (2) dimeric acids produced by the condensation of hydroxyaliphatic monocarboxylic acids having between about 16 and about 18 carbon atoms per molecule, (3) trimeric acids produced by the condensation of unsaturated aliphatic monocarboxylic acids having between about 16 and about 18 carbon atoms per molecule, and (4) trimeric acids produced by the condensation of hydroxyaliphatic monocarboxylic acids having between about 16 and about 18 carbon atom per molecule, from 50 to 150 parts by weight of a normally liquid completely or partially neutral amine salt of an oxo-alkyl acid ester of ortho-phosphoric acid in which each esterifying oxo-alkyl group contains 13 to 16 carbon atoms and the amine is an aliphatic hydrocarbon monoamine of 6 to 24 carbon atoms in which each aliphatic hydrocarbon radical is attached to the nitrogen through a saturated carbon atom, from 5 to 15 parts of an aliphatic ester demulsifier, and an amount of a saturated hydrocarbon solvent effective to provide a homogeneous solution of said additive mixture.

DESCRIPTION OF THE PREFERRED EMBODIMENTS

The polymer component of the additive mixture for the employment in the diesel fuel composition of this invention encompasses materials previously described in the art as dimers and trimers. A dimer is a condensation product or polymer of two molecules while a trimer is a condensation product of three molecules. In the present instance, the condensation of one molecule of a polyethenoid monocarboxylic acid with a molecule of a second polyethenoid monocarboxylic acid forms a dimer which is a dicarboxylic acid. Two different polyethenoid monocarboxylic acids can also condense in the same way to form a dimer or dicarboxylic acid. Trimers are formed in a similar manner by condensing three molecules of a particular polyethenoid monocarboxylic acid or a total of three molecules of two or three different polyethenoid monocarboxylic acids.

In general, the dimeric acids and trimeric acids have been produced by the heat polymerization of esters of the monocarboxylic acids to esters of the dimeric or trimeric acids followed by hydrolysis. The glycerides have also been heat polymerized and the product hydrolyzed to yield the free dimeric and trimeric acids. According to one process, unsaturated fatty acids are prepared by hydrolyzing a small portion with water and heating in a pressure vessel until substantially all of the di- and tri-unsaturated fatty acids present polymerize. The resultant product can then be heated at reduced pressure to distill off vaporizable constituents which include mainly saturated acids and monounsaturated acids. A temperature of at least 260° C. must be used and preferably one from 330° to 360° C. and a heating period of 3 to 8 hours to produce substantially complete polymerization of di- and tri-unsaturated material. Among the catalysts that can be used are mercuric acetate, lead acetate and Raney nickel.

Other fatty materials which can be employed for preparing dimeric and trimeric acids include linseed fatty acids, soya bean fatty acids and vegetable oils, including peanut, palm, olive, corn, cotton seed, and other drying or semi-drying oils. The important components of the foregoing natural oils and natural fatty esters which produce the dimeric and trimeric component employed herein are the polyethenoid monocarboxylic acids having between 16 and 18 carbon atoms per molecule. Additional details in dimeric and trimeric acids are available in U.S. Pat. No. 2,632,695 the disclosure of which is incorporated herein.

The amine salts of this invention may be prepared according to any of the methods of the art, by neutralizing completely or partially primary alkyl acid phosphates, wherein the primary alkyl groups have from 13 to 16 carbon atoms in branched-chain configuration, with an aliphatic hydrocarbon monoamine. Normally, the monoalkyl dihydrogen phosphate and the dialkyl hydrogen phosphate are completely or partially neutralized by the amine containing a total of from 6 to 24 carbon atoms with the neutral salts being preferred.

The branched chain primary alkyl acid esters of orthophosphoric acid (acid phosphates) are those esters in which only 1 or 2 of the three acidic hydrogen atoms of orthophosphoric acid have been replaced by alkyl groups, i.e., the monoalkyl dihydrogen phosphates and the dialkyl hydrogen phosphates. Such esters may be obtained according to known general methods in the art which involve reacting an alcohol with phosphorous pentoxide ($P_2O_5$). From about 2 to about 4 moles of the alcohol may be used per mole of $P_2$ $O_5$. Preferably, about 3 moles of the alcohol per mole of $P_2O_5$ will be used to yield approximately equimolar mixture of the mono- and dialkyl esters of orthophosphoric acid, i.e., containing about 40 to about 60 mole percent of the monoalkyl esters and about 60 to about 40 moles percent of the dialkyl esters. These mixtures of mono- and dialkyl esters are preferred for economy but other mixtures, as well as the single monoalkyl esters and single dialkyl esters, may also be used.

For the preparation of the branched-chain primary alkyl acid phosphates, the alcohol will be a branched chain primary alkanol having 13 to 16 carbon atoms or a mixture of two or more of such alcohols. These alcohols will preferably be the branched-chain primary alkanols made by the well-known Oxo process from CO, $H_2$ and a branched-chain olefin, such as the $C_{12}$–$C_{15}$ monoolefinic polymers and interpolymers of propylene and butylene. Examples of the preferred Oxo-alcohols that may be used are branched tridecyl primary alcohols from triisobutylene and from tetrapropylene, and the branched hexadecyl primary alcohols from pentapropylene.

The amines that are used to produce the novel salts of this invention are the aliphatic hydrocarbon monoamines containing a total of 6 to 24 carbon atoms in which each aliphatic hydrocarbon radical is attached to the nitrogen through a saturated carbon atom. The term "aliphatic hydrocarbon monoamine" will be understood to mean a compound which contains only one amino nitrogen to which is attached 1 to 3 aliphatic hydrocarbon radicals. Thus, the amines may be primary, secondary, or tertiary amines, with the primary amines being preferred and the water-insoluble amines being particularly preferred. The aliphatic hydrocarbon radicals attached to the nitrogen may be acyclic (open chain) or alicyclic (cycloaliphatic) radicals. Also, the aliphatic hydrocarbon radical may be saturated or an unsaturated radical provided that the carbon atom which is attached to the nitrogen atom is a saturated carbon atom, that is, a carbon atom that is not attached to another carbon or to the nitrogen by a multiple bond. Preferably, the amine will be an alkyl (acyclic, saturated) monoamine of 6 to 24 carbon atoms and most preferably of 8 to 18 carbon atoms. Also, preferably, when the amine is secondary amine, it will contain a total of at least 8 carbon atoms and, when it is a tertiary amine, it will contain a total of at least 10 carbon atoms.

Examples of suitable primary amines are: hexylamine; cyclohexylamine; octylamine; 2-ethylhexylamine; laurylamine; hexadecylamine; t-dodecylamine; octadecenylamine; 1,1,3-tetramethylbutylamine (t-octylamine); the mixed t-alkyl primary amine fractions having from 12 to 14 carbon atoms and from 18 to 21 carbon atoms, respectively, such as those marketed under the trade names "Primene 81R" and "Primene JM-T"; cocoamine, a mixture of $C_8$ –$C_{18}$ n-alkyl primary amine with the $C_{12}$ amine predominating; and tallow-amine, a mixture of stearyl, palmityl and oleyl amines.

Any of the above amines may be employed in salt formation with any of the above branched chain alkyl acid phosphates. Preferred, however, are 2-ethylhexylamine, t-dodecylamine, cocoamine, the mixed t-alkyl primary amine fractions containing 12 to 14 carbon atoms, t-octylamine and t-nonylamine.

Additional details of these amine salts are given in U.S. Pat. No. 3,228,758 and the disclosure of this reference is incorporated herein.

The demulsifier component of the fuel composition of this invention consists of aliphatic saturated or unsaturated carboxylic acids or mixtures thereof, which are alkoxylated either by ethylene oxide, or propylene oxide or a mixture thereof up to a molecular weight from 1000 to about 2000.

The carboxylic acid will be a saturated or unsaturated monocarboxylic acid having from 5 to 30 carbon atoms, or mixtures of a saturated and an unsaturated carboxylic acid. It is preferred to use the saturated or unsaturated monocarboxylic acids having from 5 to 18 carbon atoms.

Examples of suitable carboxylic acids are capric acid, lauric acid, palmitic acid, stearic acid, oleic acid, linoleic acid. It is preferred to use a 50/50 mixture of palmitic acid and oleic acid which have been alkoxylated with a mixture of ethylene oxide and propylene oxide up to a molecular weight of 1200 minimum.

A homogenous blend of the foregoing active additive components is achieved by blending all of the components in a saturated hydrocarbon solvent. This can be any such solvent which is compatible with the fuel composition itself and the purposes for which it was developed. In general, kerosene, cyclohexane, hexane, heptane and n-octane are highly suitable for the purpose although other economical and available $C_6$ to $C_{10}$ saturated aliphatic hydrocarbon solvents can be equally effective.

The base fuel employed in the diesel fuel composition of this invention is a mixture of hydrocarbons boiling in the range from about 310° to 475° F. characterized by being essentially smokeless and deficient in lubricity.

A preferred base fuel has an initial boiling temperature of about 320° F and an end point of about 460° F., a cetane number in the range from about 50 to 55 and contains a maximum of about 0.01% sulfur. The base fuel is generally obtained by separating an appropriate boiling fraction from a hydrocarbon distillate obtained in the refining of crude oil.

The additive mixture employed in the fuel composition of the invention generally constitutes from about 0.01 to 0.05 weight percent of the diesel fuel composition. Highly effective diesel fuel compositions are realized when the additive mixture is employed at a concentration in a range from about 0.02 to 0.03 weight percent of the fuel composition.

The fuel composition of the invention was tested for his effectiveness in bench tests and in an engine test as described below.

The Colonial Pipe Line Rust Test is conducted by putting 300 cc. of the fuel sample into a 400 cc. beaker and immersing therein a steel spindle, 3 3/16 long and ½ inch wide made from ASTM D-665-60 polished steel. The test fuel and the steel spindle are maintained at 100° F. for one-half hour. 30cc of distilled water are then added and the beaker and its contents are maintained at 100° F for 3½ hours. The spindle is removed and visually inspected and the percentage of rusted surface area is estimated.

The modified ASTM D-665 Rust Test is conducted by immersing a polished steel sample 3 3/16 inches long and ½ inch wide in 300 ml of the test fuel and 30 ml of synthetic sea water and stirring the test fuel while maintaining the fuel temperature at 90° F (32° C.) for 3 hours. The percentage of rust is estimated after visual inspection of the steel sample.

The lubricity or wear properties of the fuel composition was determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scars on the three lower balls are measured by means of a low power microscope and the average diameter measure in two directions on each of the three lower balls is taken as a measure of the anti-wear characteristics of the fuel.

The Water Tolerance Test was conducted according to ASTM D 1094 Standards. This test involves mixing a sample of the fuel with a phosphate buffer solution at room temperature. The change in volume of the aqueous layer, the appearance of the interface and the degree of separation of two phases are taken as the water reaction of the fuel.

The Emulsion Formation Test is conducted by storing the fuel composition over various pH water bottoms (PH 5, 7 and 9) for 5 days. After vigorous periodic shaking, the test fuel is examined for visual appearance of emulsion in the water phase, floc or scum at the interface and haziness of the fuel phase measured as percent turbidity by the photoelectric Lumetron colorimeter using a 1 cm cell and a 575 M filter and taking the base fuel as reference. When emulsion formation in the water phase and scum formation at the interface are not inferior to the base fuel, then the test samples are rated for haziness in the fuel phase as follows:

| Rating | Sum of % turbidities at pH 5, 7 and 9 | |
|---|---|---|
| A | 0–20 | (overall observation usually better than the base fuel) |
| B | 20–50 | (usually equivalent to the base fuel) |
| C | 50–100 | (inferior to the base fuel) |
| D | 100–150 | (rejectable) |

The Rust Suspension Test is conducted by storing the fuel composition over various pH water bottom (pH 5, 7 and 9) in the presence of iron oxide for 24 hours. After shaking, the test fuel is examined for appearance of haziness in the fuel phase measured as percent turbidity by the photoelectric Lumetron colorimeter using a 1 cm cell and a 575 M filter and taking the base fuel as reference. Ratings are given on a similar basis as for the Emulsion Formation Test.

The Fuel composition of the invention was also tested in the Petter AV-1 Engine Test. In this test, the additive containing fuel is employed for running the engine over a period of 120 hours. During this time, the condition of the exhaust is characterized and on completion of the test, the injector parts are examined for the presence or absence of lacquer and the spray hole nozzle is examined for the presence or absence of soot deposition.

The base fuel employed for preparing the diesel fuel composition of the invention was a distallate hydrocarbon kerosene fraction having the following inspection values:

TABLE I

| INSPECTION TEST ON BASE FUEL | |
|---|---|
| Gravity, API 60° F | 47.95 |
| Flash, PM, F | 120 |
| Distillation Temp. ° F | |
| IBF | 318 |
| EP | 459 |
| Sulfur, % | 0.01 |
| Cetane No. (calc) | 52 |

The additive mixture employed for preparing the diesel fuel composition of the invention consisted of 32.8 weight percent of dimer acid, which was composed of 75 weight percent of the dimer of linoleic acid, 22 weight percent of the trimer of linoleic acid and 3 weight percent of $C_{18}$ carboxylic acid, 21.7 weight percent of the 2-ethylhexylamine salt of mono- and di-tridecyl acid phosphate, 2.1 weight percent of an organic carboxylic ester consisting of a 50/50 mixture of palmitic acid and oleic acid alkoxylated with a mixture of ethylene oxide and propylene oxide to a molecular weight of 1200, and 43.4 weight percent of kerosene boiling in the range of 318° to 459° F.

The terms dimer acid and dimeric acid as used herein are equivalent as are the terms trimer acid and trimeric acid as described in U.S. Pat. No. 2,632,695.

The diesel fuel composition of the invention was prepared by adding 46 ptb (pounds per thousand barrels) of the foregoing additive package to the above described base fuel. This amount of additive in the finished fuel composition corresponded to about 0.016 weight percent. The results of the bench tests conducted on the foregoing diesel fuel composition are given in the following table:

TABLE II

| BENCH TEST DATA OF BASE FUEL AND ADDITIVE FUEL | Base Fuel Kerosene | Additive Fuel |
|---|---|---|
| — Dosage, p.t.b. (pounds per thousand barrels) | None | 46 |
| — Colonial Pipeline Rust Test Rating (A = Rust Free) | Severe Rust | A |
| — Modified ASTM D665 Rust Test Rating (A = Rust Free) | Severe Rust | A |
| — Four Ball Wear Test (600 rpm, 5 kg, 1 hr) scar diam. mm | 0.51 | |
| — Water Tolerance Test ASTM D1094 ml water absorbed | 0 | 0 |

TABLE II-continued

BENCH TEST DATA OF BASE FUEL AND ADDITIVE FUEL

| | Base Fuel Kerosene | Additive Fuel |
|---|---|---|
| Interphase condition | 1 | 1b |
| — Emulsion Formation Test | | |
| Sum of Turbidities at pH 5,7,9 in kerosene phase (Luminometer) | 16.5 | 21 |
| Rating | A | B |
| — Rust Suspension Test | | |
| Sum of Turbidities at pH 5,7,9 in kerosene phase (Luminometer) | 22 | 37 |
| Rating | B | B |

In a further comparison test, a diesel fuel composition consisting of the above described base fuel and containing 10 p.t.b. of the 2-ethylhexylamine salt of mono-and di-tridecyl acid phosphate was tested in the Four Ball Wear Test. This fuel composition gave a scar diameter of 0.64, a value essentially equivalent to the base fuel. In other Water Tolerance and Emulsion Formation Tests, employing a fuel composition similar to the diesel fuel composition of the invention but without the demulsifier, the interphase condition was degraded to a rating of 2 and scum formation occured at the interphase.

The foregoing tests show that the additive fuel of the invention provided excellent rust protection, substantially reduced wear and passed the Water Tolerance, Emulsion Formation and Rust Suspension Tests.

The exhaust monitored during the Petter AV-1 Engine Test was characterized as very clean. On completion of this test, the injector parts were found to be free of any lacquer and the spray hole nozzle showed no soot deposition. In contrast, a similar test on the Petter AV-1 engine using a diesel fuel resulted in a substantial lacquer build up on the injector and soot deposition on the nozzle.

We claim:

1. A pollution free, anti-wear diesel fuel composition comprising a non-lubricating mixture of hydrocarbons boiling in the range from about 310° to 475° F. containing from about 0.01 to 0.05 weight percent of an additive mixture composed of (A) from 100 to 200 parts by weight of a polymeric acid selected from the group consisting of (1) dimeric acid produced by the condensation of unsaturated aliphatic monocarboxylic acids having between about 16 and about 18 carbon atoms per molecule (2) dimeric acid produced by the condensation of hydroxy-aliphatic monocarboxylic acids having between about 16 and about 18 carbon atoms per molecule, (3) trimeric acids produced by the condensation of unsaturated aliphatic monocarboxylic acids having between about 16 and about 18 carbon atoms per molecule and (4) trimeric acids produced by the condensation of hydroxy-aliphatic monocarboxylic acids having between about 16 and about 18 carbon atoms per molecule, (B) 50 to 150 parts by weight of a normally liquid completely or partially neutral amine salt of an oxo-alkyl acid ester or orthophosphoric acid in which salt esterifying oxo-alkyl group contains 13 to 16 carbon atoms and the amine is an aliphatic hydrocarbon mono-amine of 6 to 24 carbon atoms in which each aliphatic hydrocarbon radical is attached to the nitrogen through a saturated carbon atom, (C) from 5 to 15 parts by weight of an aliphatic ester demulsifier consisting of the alkoxylated product from the reaction of a monocarboxylic acid selected from the group consisting of palmitic acid and oleic acid and ethylene oxide or propylene oxide to a molecular weight ranging from 1000 to about 2000, and (D) an amount of saturated hydrocarbon solvent effective to provide a homogeneous solution of said additive mixture.

* * * * *